US008561723B2

(12) United States Patent
Powell et al.

(10) Patent No.: US 8,561,723 B2
(45) Date of Patent: Oct. 22, 2013

(54) MAGNETIC HAMMER

(75) Inventors: Peter Evan Powell, Timaru (NZ); Gregory Donald West, Timaru (NZ)

(73) Assignee: Flexidrill Limited, Auckland (NZ)

( * ) Notice: Subject to any disclaimer, the term of this patent is extended or adjusted under 35 U.S.C. 154(b) by 343 days.

(21) Appl. No.: 12/733,425

(22) PCT Filed: Aug. 18, 2008

(86) PCT No.: PCT/NZ2008/000217

§ 371 (c)(1),
(2), (4) Date: Mar. 1, 2010

(87) PCT Pub. No.: WO2009/028964

PCT Pub. Date: Mar. 5, 2009

(65) Prior Publication Data

US 2010/0212967 A1 Aug. 26, 2010

(30) Foreign Application Priority Data

| | | |
|---|---|---|
| Aug. 28, 2007 | (NZ) | 560994 |
| Dec. 13, 2007 | (NZ) | 564292 |
| Apr. 29, 2008 | (NZ) | 567852 |
| Jul. 7, 2008 | (NZ) | 569675 |
| Jul. 8, 2008 | (NZ) | 569715 |

(51) Int. Cl.
*E21B 4/00* (2006.01)

(52) U.S. Cl.
USPC ..... 175/106; 173/117

(58) Field of Classification Search
USPC ..... 175/293, 328, 414, 415; 173/49, 117
See application file for complete search history.

(56) References Cited

U.S. PATENT DOCUMENTS

| | | | | |
|---|---|---|---|---|
| 2,943,216 | A * | 6/1960 | Spodig | 310/103 |
| 5,957,224 | A * | 9/1999 | Ilomaki | 175/57 |
| 2001/0045300 | A1 | 11/2001 | Fincher et al. | |
| 2007/0125578 | A1 * | 6/2007 | McDonald et al. | 175/107 |

FOREIGN PATENT DOCUMENTS

| | | |
|---|---|---|
| JP | 2008-522820 | 7/2008 |
| JP | 2009-510289 | 3/2009 |
| WO | 2005/087393 | 9/2005 |
| WO | WO 2006/065155 | 6/2006 |
| WO | WO 2007037704 | 4/2007 |

OTHER PUBLICATIONS

International Search Report dated Nov. 7, 2008.

* cited by examiner

*Primary Examiner* — David Andrews
*Assistant Examiner* — Taras P Bemko
(74) *Attorney, Agent, or Firm* — Jacobson Holman PLLC

(57) ABSTRACT

Drilling apparatus having a drillstring and operable to rotate the drillstring and operable to provide vibration axially to the drill head. Relies upon vibrational apparatus positioned to provide the vibration reliant upon interactive magnetic arrays, as a consequence of the relative rotation caused by a mechanical input to at least one array or set of arrays of the vibrational apparatus. One of the arrays or sets of arrays moves synchronously, in rotation, with the drillstring when the drillstring is rotated.

15 Claims, 15 Drawing Sheets

MAGNETIC HAMMER

This is a national stage of PCT/NZ08/000,217 filed Aug. 18, 2008 and published in English, which has a priority of New Zealand no. 560994 filed Aug. 28, 2007, New Zealand no. 564292 filed Dec. 13, 2007, New Zealand no. 567852 filed Apr. 29, 2008, New Zealand no. 569675 filed Jul. 7, 2008, New Zealand no. 569715 filed Jul. 8, 2008, New Zealand no. 560994/564292/567852 filed Aug. 5, 2008 hereby incorporated by reference.

TECHNICAL FIELD

The present invention relates to a magnetic hammer as part of a drillstring of drilling apparatus of a kind having the drillstring.

BACKGROUND ART

The present invention contemplates drilling apparatus to be operable to rotate the drillstring, or at least the drillstring's drill head or bit, or both. The magnetic hammer is to be operable to provide vibration axially to the drill head or bit. To achieve this, the magnetic hammer or vibrational apparatus which acts as such a hammer, is positioned as part of the drillstring or in the drillstring.

In our patent specification WO2006/065155 (PCT/NZ2005/000329) we disclose a method of generating a shuttling effect reliant upon magnetic arrays being able to be rotated relative to each other by a mechanical drive to a confined shuttle. It had at least one magnetic array to rotate with the shuttle and at least one magnetic array of the complementary structures providing the confinement.

The embodiments disclosed in WO2006/065155 showed the generation of vibration by the shuttling of the shuttle being carried via a rotary mounting of a drillstring into the drillstring. The drillstring had a separate rotary drive below the shuttle and was rotatable independently of both the shuttle and the confinement structure.

The vibrational output from the spindled shuttle of WO2006/065155 was via the confinement structure and not from the shuttle itself and, in the case of a drillstring, had neither the confinement structure nor the spindled shuttle synchronised to the drillstring.

The present invention recognises an advantage to be derived for several types of drilling in having vibrational apparatus, as a magnetic hammer, positioned as part of the drillstring or in the drillstring and to have part thereof synchronised to the drillstring.

As used herein the term "as part of the drillstring" can mean at the top of the drillstring but rotating at least in part synchronously with the drillstring and below any rotational drive input to the drillstring it can also mean at the bottom of the drillstring as also can "in the drillstring". The term "positioned . . . in the drillstring" means anywhere along the length of the drillstring below the rotational drive input to the drillstring if there is any.

Inclusion of the vibrational apparatus, with its magnetic arrays able to move relative to each other as part of or in the drillstring, provides other advantages.

One is the prospect of fluid drives being used multifunctionally.

Another advantage is an ability to hold part of the vibrational apparatus stationary with the drillstring even if a drive of some kind is still employed to rotate part of the vibrational apparatus anywhere along the length of the drillstring.

Another advantage arises from the ability for the hammering to be directed bidirectionally or unidirectionally, the latter if wanted to minimise damage in the opposite direction (eg, upwardly). This can be important when there is, above the vibrational apparatus in the drillstring, sensitive equipment or componentry.

Another advantage downhole is the ability to provide for the drillstring to carry at its lowest end a peripheral cutter to act in conjunction with an inner cutter, the inner part being clearly a bit or a drillhead and the peripheral part (preferably being synchronised to rotate with the drillstring) itself being a drillhead or bit.

It is a further or alternative object to provide drilling apparatus of a kind having a drillstring, operable to rotate the drillstring or at least the drillstring's drill head or bit, or both, and operable to provide vibration axially to the drill head or bit wherein vibrational apparatus, to provide the vibration, is positioned as part of the drillstring or in the drillstring.

It is a further or alternative object to employ a fluid drive to and/or from vibrational apparatus, or part thereof, of a drillstring.

It is yet a further or alternative object to provide for drillhead or bit rotation and/or vibration independently of drillstring rotation.

It is a further or alternative object to provide vibrational apparatus having a shuttling action of one or more assemblies thereof relative to the drillstring or each or one another yet deriving part of its drive via a transmission reliant on the state of rotation, if any, of the drillstring.

It is a further or alternative object to provide vibration to an inner cutter (drillhead or bit) and/or an outer cutter (drillhead or bit) of a drillstring.

DISCLOSURE OF INVENTION

In a first aspect the invention is drilling apparatus of a kind having a drillstring, operable to rotate the drillstring or at least the drillstring's drill head or bit, or both, and operable to provide vibration axially to the drill head or bit;

characterised in that, positioned as part of the drillstring or in the drillstring, is vibrational apparatus to provide said vibration;

and further characterised in that said vibrational apparatus has interactive magnetic arrays, there being at least one assembly ("first assembly(s)") with a first array or set of arrays ("first array(s)") and there being at least one assembly ("second assembly(s)") with a second array or second set of arrays ("second array(s)") such that the first array(s) and second array(s) interact, responsive to relative rotation between said first array(s) and said second array(s), to cause shuttling of the first array(s) relative to the second array(s), or vice versa, or both, and thus their respective supporting assemblies;

and still further characterised in that the relative rotation can be caused by a mechanical input to one or other of said first and second assembly(s), or both the first and second assembly(s), and further characterised in that one of the first and second array(s) and its assembly(s) moves synchronously in rotation with the drillstring when the drillstring is rotated.

Optionally, the drill head or bit vibrates as a consequence of direct or indirect carrying of or hammering of, or both, the drill head or bit by the first assembly(s). Alternatively, optionally the drill head or bit vibrates as a consequence of direct or indirect, carrying of or hammering of, the drill head or bit, or both, by the second assembly(s) or both.

Optionally the first and second array(s) and their first and second assembly(s) can rotate in opposite directions.

Preferably the first and second array(s) and their first and second assembly(s) can rotate in the same direction, Preferably one of the first and second array(s) and its first and second assembly(s) can be non-rotating when the other of the first and second array(s) and first and second assembly(s) is rotating.

Preferably or optionally the vibrational apparatus is below the rotational drive into the drillstring (eg, in the drillstring).

Preferably a rotary drive into a spindle, as one of said first and second rotatable members causes unidirectional or bidirectional hammering.

Optionally rotary drive is that of a mud motor, fluid motor or electric motor or other mechanical or electrical drive.

Preferably the other of said first and second rotatable members is rotatable by or with the drillstring.

Optionally the vibration apparatus is elongate with a casing as its exterior. That case preferably moves in unison with the drillstring ie, in synchrony and at the same speed. Otherwise, while in synchrony it may move at a different speed.

Optionally gearing provides a rotary speed greater or less for one of said magnetic array(s) and/or bit rotation speed relative to a rotary drive input or for giving a differential drive for the bit eg, a different speed to the drillstring and/or first rotary member. Examples include a planetary gearing system.

Optionally a viscous coupling provides a drive to one of said magnetic array(s).

Optionally the drillstring rotates a cutter and there is a drill head internally of that cutter (i) able to the rotated differently to the drillstring insofaras speed is concerned, (ii) able to be vibrated relative to the cuter of the drillstring, or (iii) both.

Preferably the magnetic arrays(s) are staged axially with respect to the drillstring axis. Preferably at least some are interposed between arrays of the other magnetic array(s).

In another aspect the invention is componentry (whether all or some only whether in assembly or disassembly, or partly both) of drilling apparatus of the present invention.

In yet a further aspect the present invention consists in apparatus substantially as herein described with reference to any one or more of the accompanying drawings and/or useful in a method or as a downhole assembly as previously defined.

Accordingly in another aspect the invention consists in vibrational apparatus comprising or including (i) a first member directly or indirectly able to act, whether via a drill string or otherwise, upon a drill head or bit assembly to pass axial vibration into such a drill head or bit assembly, said first member having at least one array of magnets, (ii) a second member carrying at least one array of magnets to complement the at least one array of said first member, thereby upon relative rotation to provide magnetic interactions, said second member and its complementary array or arrays of magnets to rotate relative to the first member, or vice versa, or both, with said second member being able and caused by the magnetic interactions to shuttle between shuttling limits on or relative to said first member, and (iii) at least one drive and/or transmission to cause such relative rotation, ie, of said first member relative to the second member, or vice versa, or both.

Accordingly in an aspect the invention consists in vibrational apparatus comprising or including (i) a first rotatable member directly or indirectly connectable to a drill head or bit assembly, or directly or indirectly connectable to a drill string to have or having a drill head or bit assembly, able to pass its rotation into any such connected drill head or bit assembly, or drill string and drill head or bit assembly, and able to pass axial vibration into such a drill head or bit assembly, or drill string and drill head or bit assembly, said first rotatable member having at least one array of magnets that it carries during its rotation, (ii) a second rotatable member carrying at least one array of magnets to complement the at least one array of said first rotatable member, said second rotatable member and its complementary array or arrays of magnets to rotate about said first rotatable member, and said second rotatable member being able to shuttle between shuttling limits on or relative to said first rotatable member, and (iii) a drive or drives, (preferably at least one drive to cause rotation of said first rotatable member and preferably at least one drive) to rotate the second rotatable member relative to said first rotatable member or vice versa;

wherein relative rotation between the first and second rotatable members causes such relative rotation between the magnetic arrays as will shuttle said second rotatable member relative to said first rotatable member thereby to generate axial vibration into said first rotatable member.

In another aspect the invention consists in a hammer bit assembly connected to, forming part of, or connectable to, a drill string, or subassembly and/or componentry thereof, the assembly comprising or including a tubular casing to rotate with the drillstring, at least one array of magnets carried within the casing and to rotate therewith, a first gear (eg, outer gear) carried within the casing, such first gear being of a planetary gearing system, a shaft within the casing, the shaft being mounted to enable both axial shuttling and rotation of the shaft relative to the casing, a second gear of the planetary gearing system (eg, sun gear) carried to rotate with the shaft, at least one array of magnets carried by the shaft to rotate and shuttle axially therewith, and a bit mounted, or a bit mountable, to rotate with the rotational axis of at least one planet gear of the planetary gearing system:

wherein the bit is, or can be, directly or indirectly hammerable by axial shuttling of the shaft relative to the casing;

and wherein, at least one magnetic array of the casing and at least one magnetic array of the shaft interact to cause shuttling of the shaft relative to the casing when there is a difference in rotational speed of the shaft relative to the casing;

and wherein there is a speed differential dependent drive (eg, viscous, drag, centrifugal and/or equivalent) between the shaft and the casing whereby rotational slowing of the mounted bit, and thus the shaft, relative to the rotation of the casing, in use, will increase the shuttling effect of the shaft, and vice versa.

In another aspect the invention consists in a hammer bit assembly connected to, forming part of, or connectable to, a drill string, or subassembly and/or componentry thereof, the assembly comprising or including a tubular casing to rotate with the drillstring, at least one array of magnets carried within the casing and to rotate therewith, a shaft within the casing, the shaft being mounted to enable both axial shuttling and rotation of the shaft relative to the casing, at least one array of magnets carried by the shaft to rotate and shuttle axially therewith, a geared rotational drive from the casing or the shaft, and a bit mounted, or a bit mountable, to be rotated by the geared rotational drive;

wherein the bit is, or can be, directly or indirectly hammerable by axial shuttling of the shaft relative to the casing;

and wherein, at least one magnetic array of the casing and at least one magnetic array of the shaft interact to cause shuttling of the shaft relative to the casing when there is a difference in rotational speed of the shaft relative to the casing.

In another aspect the invention is drilling apparatus comprising or including a tubular housing assembly adapted at one end for direct or indirect connection to a drill string to be rotated thereby when drilling and having or being adapted to have at the other end, a bit, a shuttle mounted to reciprocate axially of said housing assembly and being adapted, when shuttling, to pass (directly or indirectly) a vibrational or hammering affect into the bit, at least one magnetic array fixed to rotate with the housing assembly, and at least one complementary magnetic array to rotate with the shuttle, wherein relative rotation of said shuttle to said housing assembly will cause interaction between the pair, or pairs, of complementary magnetic arrays to cause shuttling of the shuttle and thus vibration or hammering of the bit, and wherein the bit includes a tactile feedback to cause shuttle rotation, and thus shuttling, when rotationally slowed relative to the tubular casing.

In another aspect the invention consists in a method of drilling a bore in a sub-surface formation by a drilling assembly, said method comprising or including the steps of (a) conveying the drilling assembly into the well bore, and (b) simultaneously and/or serially (i) rotating the drill bit as part of the drill string or an outer drill bit about the drill axis as part of the drill string, and (ii) vibrating the drill bit or rotating and vibrating an inner drill bit axially with respect to the drill axis, wherein the axial vibration of the drill bit or inner drill bit is caused by the application of a fluid into a fluid motor of the assembly which causes a shuttle to rotate about a rotationally axis at least substantially aligned with the drill axis thereby, with magnetic interactions between magnetic arrays of the shuttle and magnetic arrays able to coact therewith, to cause axial reciprocation of the shuttle and thus the drill bit or inner drill bit.

In another aspect the invention consists in an assembly for use in drilling a bore in a sub-surface formation, said assembly comprising or including a drill bit, a shuttle directly or indirectly connected to said drill bit or engaging said drill bit directly or indirectly and able to reciprocate on an axis coincident with or parallel to the drilling axis of the drill bit, a fluid motor able to rotate said shuttle, and at least two magnet arrays adapted to cause reciprocation of said shuttle responsive to rotation of the shuttle.

In another aspect the invention consists in an assembly for use in drilling a bore in a sub-surface formation, said assembly having a housing, a drill bit having a rotational axis at a lower extremity of the housing, a shuttle within the housing directly or indirectly connected to said drill bit, or engaging said drill bit directly or indirectly, thereby to cause reciprocation of the drill bit as it reciprocates on an axis coincident with or parallel to the rotational axis of the drill bit, the shuttle carrying at least one array of magnets, a complementary array or complementary arrays of magnets in the housing not carried by the shuttle, a fluid motor in the housing, and a gear system (eg, a reduction gear system) in the housing:

wherein said fluid motor rotates the shuttle thereby to cause shuttling as a result of magnetic interactions between mating arrays;

and wherein said fluid motor, through the gear system, rotates the drill bit.

In another aspect the invention is an assembly comprising or including a housing or containment member or assembly ("housing") connected to or connectable to a drill string and able to receive fluid from within the drill string, a fluid motor in the housing to be powered by such a received fluid, a shuttle in the housing having at least one magnetic array, the shuttle being rotatable by the motor, a complementary magnetic array or complementary magnetic arrays within the housing and not carried by the shuttle to cause with magnetic interactions shuttling of the shuttle as a consequence of its being rotated by the motor, a gearing system (eg, a reduction gearing system) in the housing to receive a drive from said motor, and a bit rotatably mounted relative to the housing so as to be rotatable by the output of the gearing system and so as to be axially reciprocated by shutting of the shuttle.

Preferably said housing has the rotational axis of the shuttle aligned with that of said bit.

In a further aspect the present invention consists in, in combination, subassembly or assembly, in and/or for a method of drilling a well bore in a sub-surface formation by a drilling assembly that includes a drill bit, or suitable for use as an assembly for use in drilling a bore in a sub-surface formation, a housing to be able attachable at the end of a drill string, a bit at the lower end of such housing and able to rotate relative to the housing and to reciprocate on its rotational axis relative to the housing, a shuttle within said housing connected or able to cause such reciprocation of the drill bit axially of the drill bit's rotational axis, at least one fluid motor within, carried by or carrying the housing, the, or a, fluid motor being able directly or indirectly to rotate said shuttle, and a gear assembly to receive drive directly or indirectly from the, or a, said fluid motor, and to provide the rotational drive to the bit, and at least one pair of complementary magnetic arrays within the housing, one array of the or each pair being carried by the shuttle and one array not being so carried, adapted to cause reciprocation of said shuttle responsive to fluid motor caused rotation of the shuttle.

In a further aspect the present invention consists in, in combination, subassembly or assembly, in and/or for a method of drilling a bore in a sub-surface formation by a drilling assembly, a housing to be able attachable at the end of a drill string, a bit or bits at the lower end of such housing and able to be rotated with said housing and/or to be caused to rotate relative to the housing, a shuttle within said housing connected or connectable directly or indirectly to said drill bit or a said drill bit and able to impart vibration into the or that drill bit axially of the drill bit's rotational axis, a fluid motor within, carried by or carrying the housing able to rotate said shuttle, and at least two pairs of complementary magnetic arrays within the housing adapted to cause reciprocation of said shuttle responsive to rotation of the shuttle.

In another aspect the invention is drilling apparatus (whether downhole or not) comprising or including a tubular housing assembly adapted at one end for direct or indirect connection to a drill string to be rotated thereby when drilling and having or adapted to have at the other end, a peripheral or outer (eg, annular) ("outer bit") bit ("bitted end"), a shuttle mounted to reciprocate axially of said housing assembly and being adapted to have, or having at its end, proximate to the bitted end of the housing assembly, an inner bit, a fluid motor within the housing assembly adapted to receive and be driven by a down drill string fluid feed, a transmission from said motor to said shuttle to rotate the shuttle about the longitudinal axis of the housing assembly and thereby also said inner bit in use, at least one magnetic array fixed to rotate with the housing assembly, and at least one complementary magnetic array to rotate with the shuttle, wherein relative rotation of said shuttle to said housing assembly will cause interaction between the pair, or pairs, of complementary magnetic arrays to cause shuttling of the shuttle and its inner bit relative to the housing assembly and its outer bit.

In an aspect the invention consists in a method of drilling a bore in a sub-surface formation by a drilling assembly that includes a down hole assembly drill bit or a downhole assembly of inner and outer drill bits, said method comprising or including the steps of (a) conveying the drilling assembly into the well bore, and (b) simultaneously and/or serially (i) rotating the drill bit as part of the drill string or an outer drill bit about the drill axis as part of the drill string, and (ii) vibrating the drill bit or rotating and vibrating an inner drill bit axially with respect to the drill axis, wherein the axial vibration of the drill bit or inner drill bit is caused by an axial rotary drive downhole (eg, by or via the drill string) to cause a shuttle to rotate about a rotationally axis at least substantially aligned with the drill axis thereby, with magnetic interactions between magnetic arrays of the shuttle and magnetic arrays able to coact therewith, to cause axial reciprocation of the shuttle and thus the drill bit or inner drill bit.

In an aspect the invention consists in a method of drilling a bore in a sub-surface formation by a drilling assembly that includes a down hole assembly having a drill bit, said method comprising or including the steps of (a) conveying the drilling assembly into the well bore, and (b) simultaneously (i) rotating the drill bit (ii) reciprocating the drill bit with respect to the drill axis.

In another aspect the invention consists in an assembly for use in drilling a bore in a sub-surface formation, said assembly comprising or including a drill bit, a shuttle directly or indirectly able to reciprocate on an axis coincident with or parallel to the drilling axis of the drill bit, a fluid motor or fluid motors ("fluid motor") to rotate said shuttle and to rotate said bit, and at least two magnet arrays adapted to cause reciprocation of said shuttle responsive to rotation of the shuttle.

In another aspect the invention consists in an assembly for use in drilling a bore in a sub-surface formation, said assembly comprising or including a drill bit, a shuttle directly or indirectly connected to said drill bit and able to reciprocate on an axis coincident with or parallel to the drilling axis of the drill bit, a drive by or via the drill string (eg, the drill string itself and/or a fluid flow to a fluid motor) to rotate said shuttle, and at least two magnet arrays adapted to cause reciprocation of said shuttle responsive to rotation of the shuttle.

In a further aspect the present invention consists in, in combination, subassembly or assembly, in and/or for a method of drilling a bore in a sub-surface formation by a drilling assembly, a housing to be able attachable at the end of a drill string, a bit or bits at the lower end of such housing, the bit or at least one bit being able to be rotated relative to the housing, a shuttle within said housing able to reciprocate the or the at least one drill bit axially of the drill bit's rotational axis, a fluid motor drive to rotate said shuttle, at least one pair of complementary magnetic arrays within the housing, one of the or each pair carried by the shuttle, adapted to cause reciprocation of said shuttle responsive to rotation of the shuttle, and a geared drive from the fluid motor to the bit or the at least one bit.

In a further aspect the present invention consists in, in combination, subassembly or assembly, in and/or for a method of drilling a bore in a sub-surface formation by a drilling assembly, a housing to be able attachable at the end of a drill string, a bit or bits at the lower end of such housing and able to be rotated with said housing and/or to be caused to rotate relative to the housing, a shuttle within said housing connected or connectable directly or indirectly to said drill bit or a said drill bit and able to impart vibration into the or that drill bit axially of the drill bit's rotational axis, a drive to rotate said shuttle, and at least two pairs of complementary magnetic arrays within the housing adapted to cause reciprocation of said shuttle responsive to rotation of the shuttle.

In another aspect the invention is drilling apparatus comprising or including a tubular housing assembly adapted at one end for direct or indirect connection to a drill string and having or adapted to have at the other end, a drill bit, a shuttle mounted to reciprocate axially of said housing assembly, a drive from a fluid motor to cause shuttle rotation, at least one magnetic array fixed with respect to the housing assembly, at least one complementary magnetic array to rotate with the shuttle, and a geared reduction output from the fluid motor, whether via the shuttle or not, to the drill bit to cause its rotation;

wherein relative rotation of said shuttle to said housing assembly will cause interaction between the pair, or pairs, of complementary magnetic arrays to cause shuttling of the shuttle and thus axial reciprocation of the drill bit relative to the housing.

In another aspect the invention is chilling apparatus comprising or including a tubular housing assembly adapted at one end for direct or indirect connection to a drill string to be rotated thereby when drilling and having or adapted to have at the other end, a peripheral or outer (eg, annular) ("outer bit") bit ("bitted end"), a shuttle mounted to reciprocate axially of said housing assembly and being adapted to have, or having at its end, promimate to the bitted end of the housing assembly, an inner bit, an axial drive for the shuttle to cause its rotation, at least one magnetic array fixed to rotate with the housing assembly, and at least one complementary magnetic array to rotate with the shuttle, wherein relative rotation of said shuttle to said housing assembly will cause interaction between the pair, or pairs, of complementary magnetic arrays to cause shuttling of the shuttle and its inner bit relative to the housing assembly and its outer bit.

As uses herein the terms "drill head", "bit", "bit assembly" "drill string" are to be considered interchangeable (ie, they are not restrictive in one with respect to the other), unless the context specifically requires.

As used herein, reference to a "drill string" "drilling", or the like does not mandate that the drilling is necessarily vertically downwards. Drilling can indeed be in any direction.

Reference herein to "axial" or "axially" in respect of the vibrations means generally in a direction at least substantially parallel to the drill head, bit, bit assembly and/or drillstring axis.

As used herein the term "and/or" means "and" or "or", or both.

The terms "directly" or "indirectly" and "direct" or "indirect" in respect of the vibration arising from hammering refers unidirectional or bidirectional transmission via one or other of the components involved with the hammering.

The terms "hammer" or "hammering" can be solid to solid interactions, solid to liquid covered solid surface interactions or other. "Moreover "hammer", "hammering", etc can mean hammering be in both axial directions (eg, bidirectional, if vertical drilling, upward and downward). It can, as seen in some embodiments, instead can be unidirectional in an axial direction (eg, downwardly). Positive hammering both ways lends to both drilling and back reaming. Vibration from unidirectional hammering (eg, downwardly conducive to drilling) can reduce vibrational damage above the apparatus.

As used herein "(s)" following a noun means the plural and/or singular forms of the noun.

The term "comprising" as used in this specification means "consisting at least in part of". When interpreting statements in this specification which include that term, the features, prefaced by that term or some equivalent are present but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

BRIEF DESCRIPTION OF DRAWINGS

Preferred forms of the present invention will now be described with reference to the accompanying drawings in which

FIG. 1 shows a diagram where there is a cutting head 1 (ie, the drillhead or bit) driven by the outer casing 2 which is the second rotational member. This casing or second rotatable member is rotated by drillstring rotation from further up hole.

Figure 1:
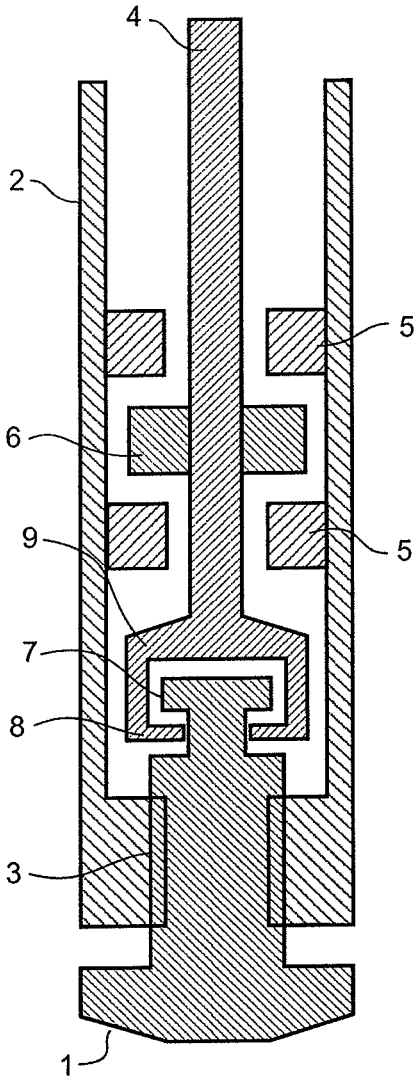
FIG. 1 is a drawing as a concept showing a downhole arrangement able to hammer indirectly the bit in both directions ("bidirectionally") as a consequence of rotation of a central first rotatable member relative to a second and outer rotatable member powered by drillstring rotation, the first rotatable member acting as the hammer.

The cutting head 1 is splined 3 to slide relative to the second rotatable member in the axial direction and to receive rotational drive therefrom.

The first rotatable member 4 as a hammer is a centre shaft powered by mud motor or other arrangement not shown, the second rotatable member carries arrays 5 which interact with arrays 6 carried by the first rotatable member.

Thus the relative rotation between the interactive arrays of 5 and 6 is such as to cause shuttling of the second rotatable member relative to the first rotatable member 4, or vice versa, or both. This has the outcome that the member 7 (captive between 8 and 9 of member 4) receives the hammering from first rotatable member 4.

It can be seen that such an arrangement lends itself to a small overall girth suitable for downhole application.

Figure 2:
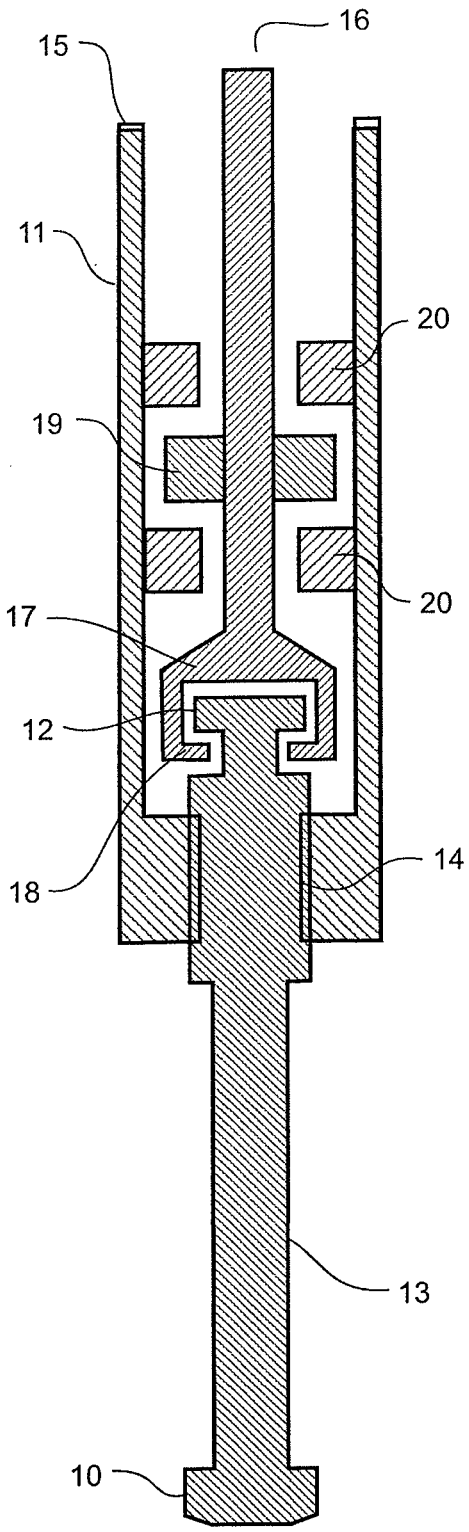
FIG. 2 is similar to FIG. 1 in all aspects in that there is a length (a short length only is shown) of drill rod being interposed between bit and the part being hammered.

The arrangement as shown in FIG. 2, while appearing a similar bidirectional indirect hammer arrangement to that of FIG. 1, lends itself better for further up the drillstring assembly, ie, can act as a top hammer or somewhere in between.

Here the cutting head 10 via drill rods 13 is rotated by the second rotatable member 11 as the outside casing 11 splined to the top of the drill rods. The cutting head 10 receives vibration from 12 as a result of its interactions with 17 and 18 of the first rotatable member 16. As can be seen the cutting head is connected by a drill rod 13 to the spline connection 14 with the second rotatable member or casing.

The second rotatable member is adapted to be powered via 15 by hydraulic motor or other mechanical input. The first rotatable member 16 hammers 12 captured by regions 17 and 18 (as was the case in the FIG. 1 concept) such that there is interaction between 12 and each of 17 and 18 to provide the vibration down through the drill rod to the cutting head 10. This arises from relativity of rotational movement between the first and second rotatable Members 16 and 11 respectively carrying respectively magnetic arrays 19 and 20 and the resultant axial relative movement.

Both of the concepts depicted in FIGS. 1 and 2 are both ways hitting. This is irrespective of whether or not, for example, the outer casing or second rotatable member 11 is stationary, reversed or in the same direction with respect to the rotation of the central shaft 16, or vice versa.

Figure 1A:
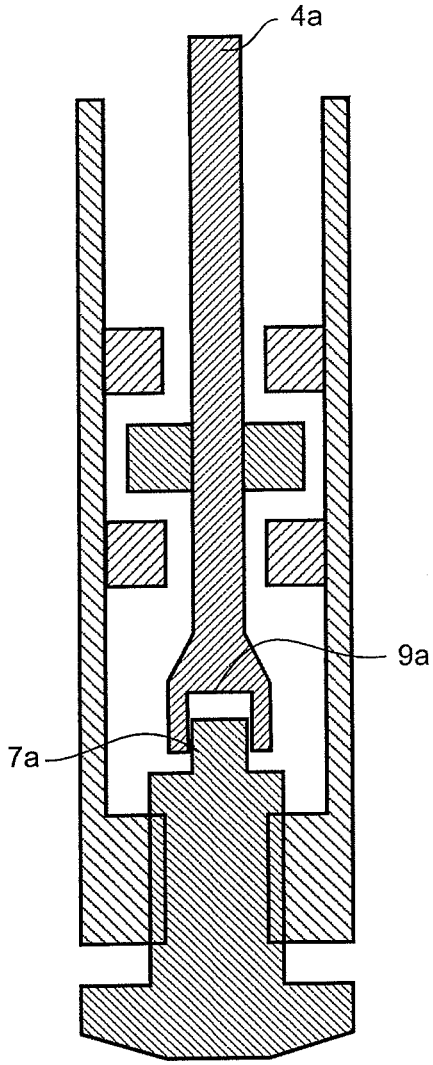
FIG. 1A is a diagram similar to the downhole arrangement of FIG. 1 but showing the first rotatable member not capturing the hammer or not being able to hammer indirectly the bit in both directions, ie, a unidirectional arrangement.
Figure 2A:
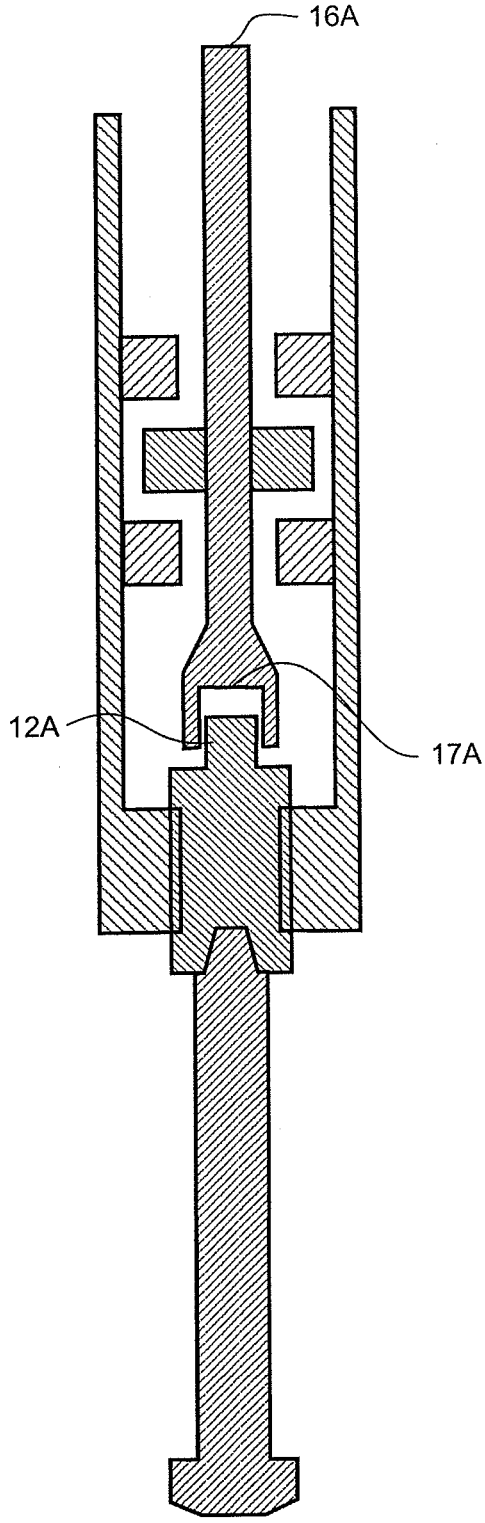
FIG. 2A is a similar arrangement, in respect of FIG. 2, as is FIG. 1A to FIG. 1.

The arrangements of FIGS. 1A and 2A are the same as for FIGS. 1 and 2 save for being unidirectional ie, 7A being acted upon by the first rotatable member 4A or 16A downwards (with reference to FIGS. 1A, 2A) as a consequence of impact between 7A and 9A or 12A and 17A.

Figure 3:
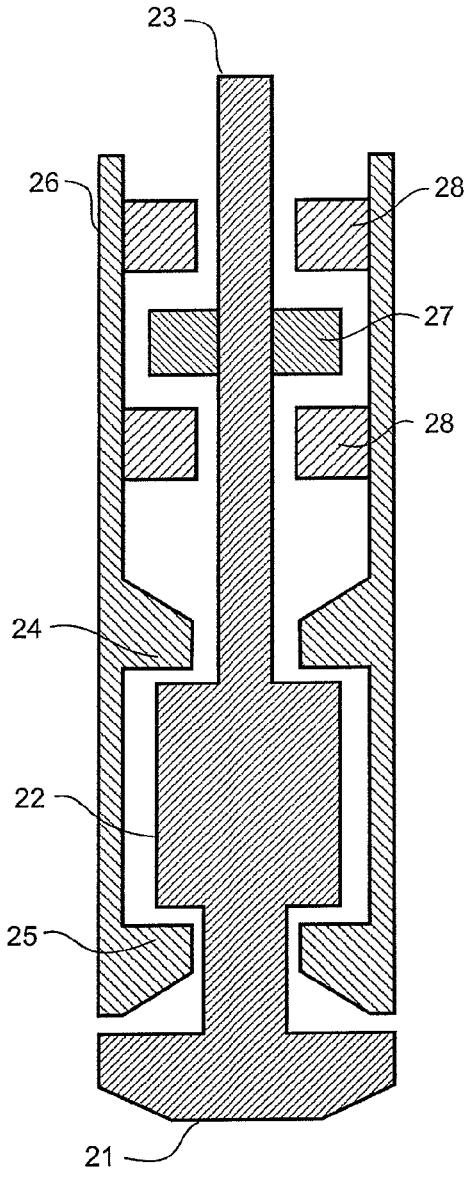
FIG. 3 shows as a conceptual drawing a direct arrangement where a central first rotatable member, powered by mud motor or other mechanical input, can be caused to rotate to directly cause the cutting head to rotate, the surrounding second rotatable member being powered or held by the drillstring rotation or its static status, the hammer of the first rotatable member carrying the cutting head but hammering and/or being hammered by the surround attached to the drill string.

FIG. 3 shows a third concept and this time a downhole concept, here the cutting head 21 is directly axially moved by the hammer 22 acting within regions 24 and 25 which forms part of the first rotatable member 23 which is a central shaft powered by mud motor, fluid motor or other mechanical input.

The hammer 22 acts within regions 24 and 25 of the second rotatable member or casing 26 which is rotated, or held, by the drillstring, ie, it is powered by the drillstring when the drillstring rotates. In this arrangement the magnetic arrays 27 of the first rotatable member 23 interact with the magnetic arrays 28 of the second rotatable member 26 thus to cause the central shaft at 22 to hammer back and forth on regions 24 and 25 of the second rotatable member and/or, by relativity of axial movement between members 23 and 26, to derive a hammering affect which carries directly to the cutting head 21. It matters not what is considered the hammer, (ie, whether it is the pairing of regions 24 and 25 or the member 22 having hammering faces carried by the first rotatable member) but, for consistency of explanation, this is a "direct" arrangement unlike the "indirect" arrangements of FIGS. 1 to 2A, and hence the member 22 is the hammer.

Figure 4:
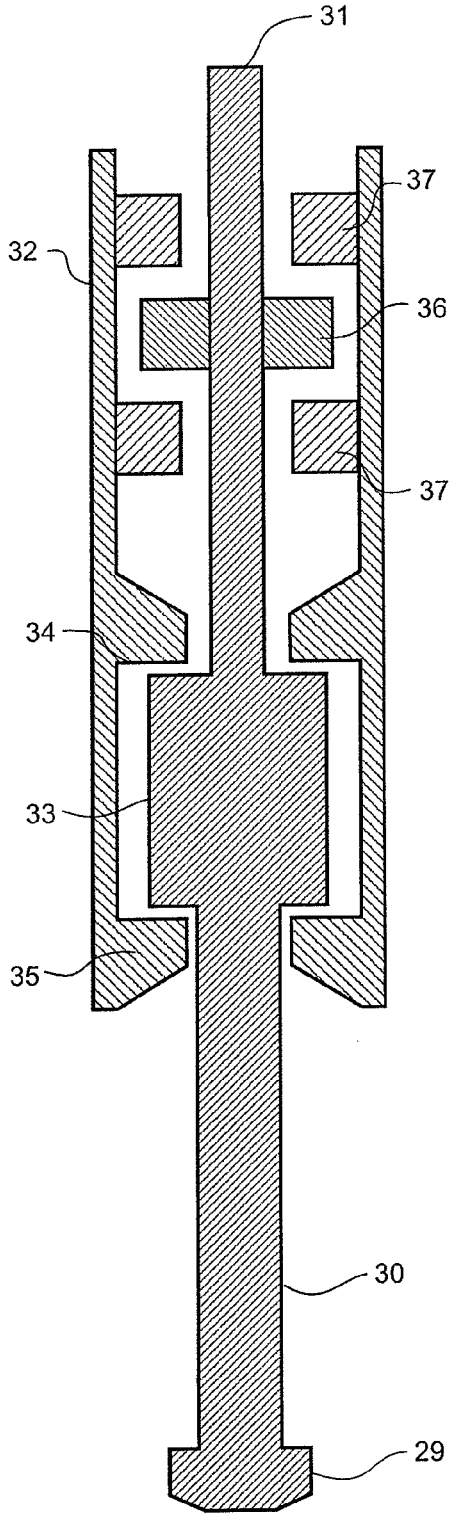
FIG. 4 is a similar direct arrangement to that of FIG. 3 but where drill rods are interposed between the first rotatable member and the cutting head, the FIG. 4 embodiment not necessarily being downhole or deep downhole, ie, it could be any point along, including at a top end of the drillstring, with drill rods between the hammer of the first rotatable member and the cutting head.

FIG. 4 shows yet a further embodiment.

Here a cutting head 29 is driven by a central shaft through the drill rods 30. The central shaft is the first rotatable member 31. It is powered by a drill spindle or other means as this arrangement is able to be moved further up hole or can be used as a top hammer of the drill string.

Nevertheless the outer casing is the second rotatable member 32.

The hammer 33 is acted upon by regions 34 and 35 of the outside casing or second rotatable member 32.

Thus relative reciprocation between 34, 35 and 33 causes the hammering affect, the vibration arising from the movement of the outer casing relative to the drillstring, vice versa, or both.

The drillstring is synchronised to rotate with magnetic arrays 36 of the first rotatable member 31. These interact with magnetic arrays 37 carried by their first second rotatable member. This causes the mutual movement that results in the hammering.

Figure 5:
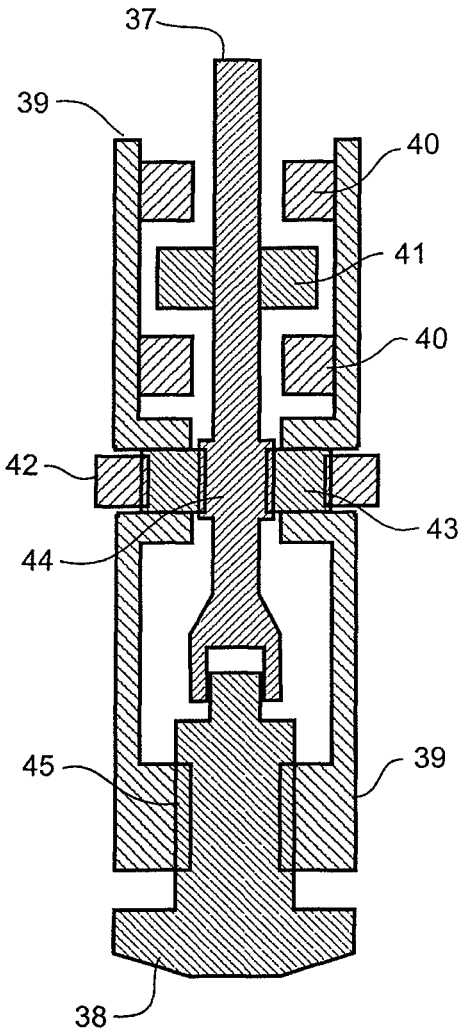
FIG. 5 is a variation of the indirect concept of FIG. 1A where useable downhole is a unidirectional hammer arrangement, the surrounding drillstring or casing of the vibrational apparatus having a ring able to deploy to engage the ground thereby to transmit the state of its lack of rotation back to the central shaft able to hammer on the cutting head.

FIG. 5 shows the arrangements of FIG. 1A. Here however the first rotary member 37 hammers indirectly to the cutting head 38. The second rotary member 39 is rotated by drillstring rotation carrying with it its magnetic arrays 40. Magnetic arrays 41 of the first rotatable member 34 are interposed but of course there can be a series of co-actions substantially as hereinafter described with reference to FIGS. 16 and 17.

Where the arrangement of FIG. 5 differs is that a peripheral wing 42 is provided as a ground engaging ring adapted to act via a gear system that involves members 43 about a sun region 44 of the first rotatable member 37 so that there can be a relationship between the first rotatable member 37 and the outside ring 42. As 42 engages the formation it ceases to rotate causing 37 (via 43) to rotate relative to 40 and thereby causing axial impact at the bit (38) via the hammer at the downhole end of 37. The hammer not being directly connected to the bit can in such circumstances simply reciprocate axially to cause hammering on the cutting head. In this situation the extension of the casing or second rotatable member 39 into the splined region 45 rotates the drill head 38 not any rotational affect passing down through the central shaft 37. However the rotation of shaft 37 when and if it occurs can have an affect on the nature of the resultant vibratory system as it affects relativity of speed of the magnetic arrays.

Figure 6:
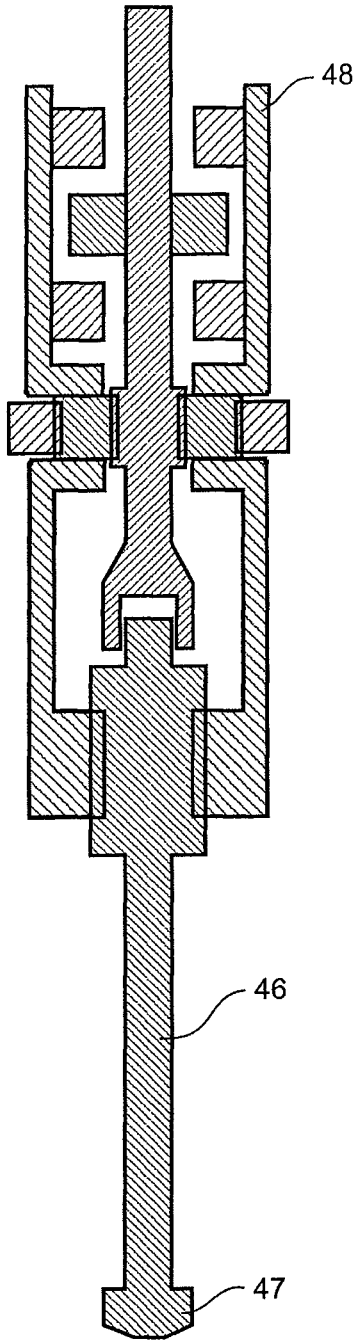
FIG. 6 is a similar indirect arrangement to that of FIG. 5 but where the apparatus can be used other than fully downhole, ie, somewhere along the drillstring length or as a top hammer.

The arrangement of FIG. 6 is identical to that of FIG. 5 save for drill rods 46 being shown down to the cutting head 47.

As can be appreciated in a drilling scenario any upward extension of the region 48 (ie, that of the casing or second rotatory member 39) but still within the hole or otherwise below a main drive, can be considered the drill string as can the drill rods 49 downhole from the vibratory apparatus or part thereof above drill rods 46.

Figure 7:
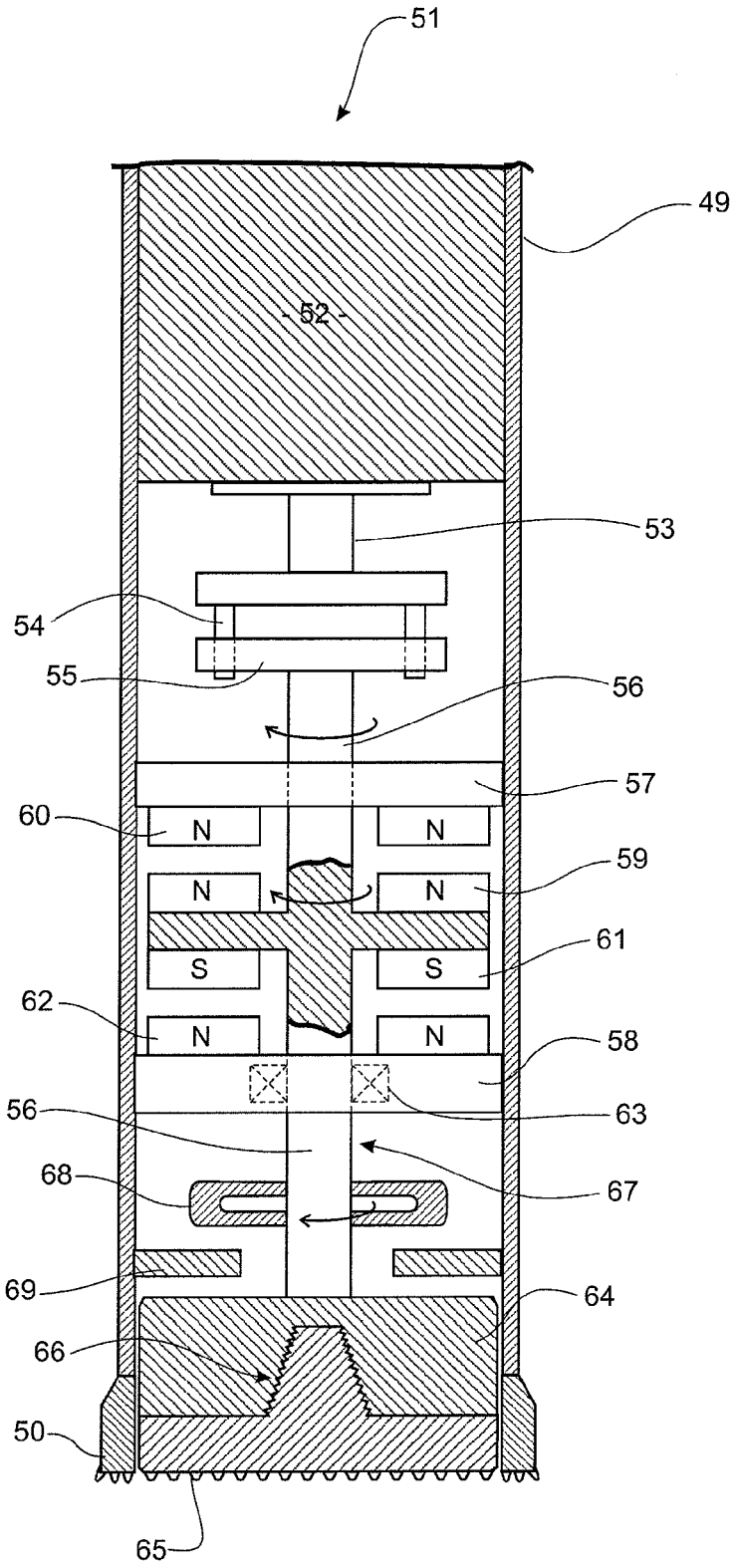
FIG. 7 shows a diagram of a compound cutting head where the surround carries cutters at the bottom of the casing forming part of the drillstring to rotate about a central cutter able to be rotated under the action of a motor of some kind transmitted, via a central shaft that carries some of the magnetic arrays, to interact by mutual shuttling relative to the complementary arrays held to the casing.

In FIG. 7 there is shown a cylindrical housing 49 having an outer bit or cutter 50 at the lower end thereof. The outer bit 50 rotates synchronically with the tubular housing 49 which is connected at its top, end region 51 to a mud motor then into a drill string in a conventional manner.

The assembly is adapted to receive a fluid downfeed into the motor 52 carried by the device (the preferred form being a PDM or mud motor). The motor 52 drives to cause rotation of the spindle 53 then 56 of the shuttle 67 through the coupling 54.

The shuttle 67 is sealed by a seal 57 as well as a seal 58 so as to protect shuttle magnetic array formulations 59 and 61 which co-act with those magnetic array formations 60 and 62 that do not rotate with the spindle.

As part of a seal assembly 58, bearings are provided at 63 for the shaft 56 of the shuttle. These act in addition to a sliding bearing region 64 of the shuttle which carries the inner bit 65 which is engaged at 66 with the region 64.

If other bearings are required for the shaft, they can be provided.

Preferably seals 57 and 58 are provided to keep mud and other debris away from the magnetic arrays.

Preferably also there is a projection 68 of the shuttle and a projection 69 of the housing that are surrounded in a liquid or fluid (preferably a liquid such as an oil), or can impact on a film of liquid, so as to provide a stop against magnet to magnet collision as well as to impart shock ie, the hammering.

A person skilled in the art will appreciate how a shuttle having an axial float relative to the transmission from the motor 52 ie, the transmission being the member 53 carrying the members or pins 54 which co-act with the member 55 of the shuttle. Additional bearing or radial support can, if desired, be provided.

Other support and/or drives can be used.

Optionally the shuttling inner bit can be adapted to strike an inner lip or outer part of the drill string thereby to pass shock to the teeth of the string ie, the outer bit.

As described in respect of FIG. 7 reference was made to the first rotatable member being a shuttle and the second rotatable means being the surround, ie, the casing or drill string.

As will be apparent from the earlier descriptions an inner and outer cutting or bit type arrangement can be provided using some of the mechanisms described with respect to other embodiments therein, ie, with the unidirectional and/or bidirectional hammering features and irrespective of whether or not the first or second rotatable member carries the hammer and irrespective of whether or not the other carries the complementary surfaces.

Figure 8:
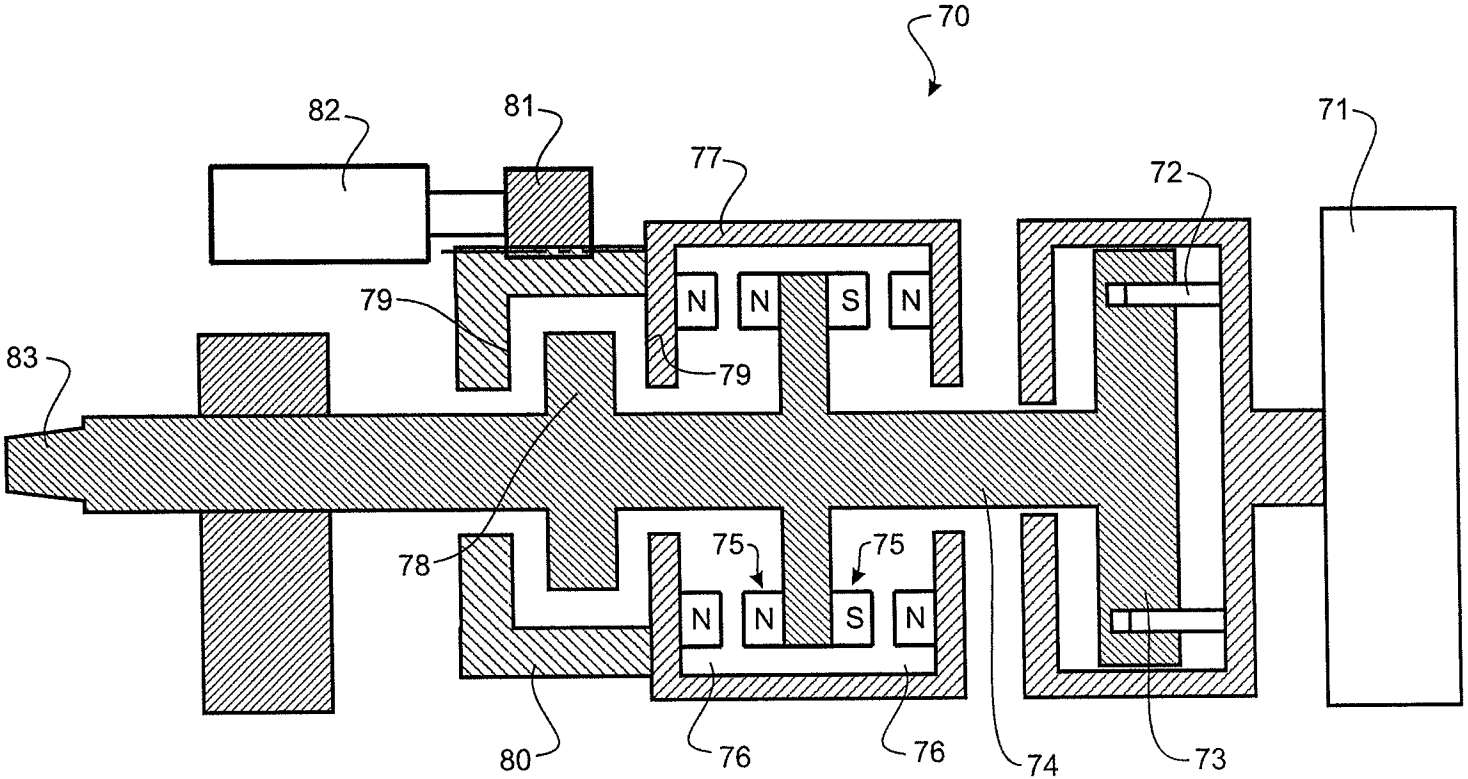
FIG. 8 is a diagram showing interacting magnetic arrays and a separate mechanical drive for the surround as a shuttle relative to a central spindle to which other magnetic arrays are mounted, the spindle carrying a hammer and being rotatable under appropriate inputs to cause a vibrating and rotating spindle output to the left (ie, direct action)
Figure 9:
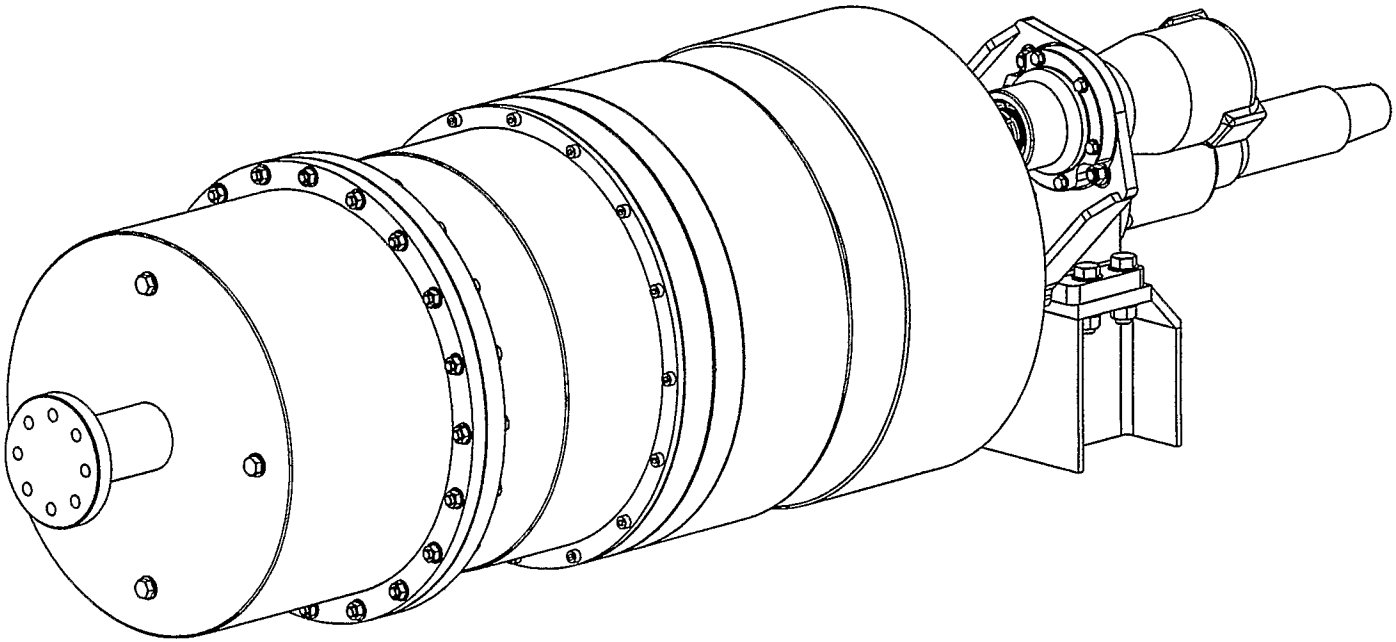
FIG. 9 is an isometric view of a top hammer assembly of a kind having an input drive from the left and having a central shaft carrying the hammer and extending to the right to a output shaft connectable into the downhole or further downhole drillstring, therebeing the prospect of drillstring rotational input from the left.
Figure 10:
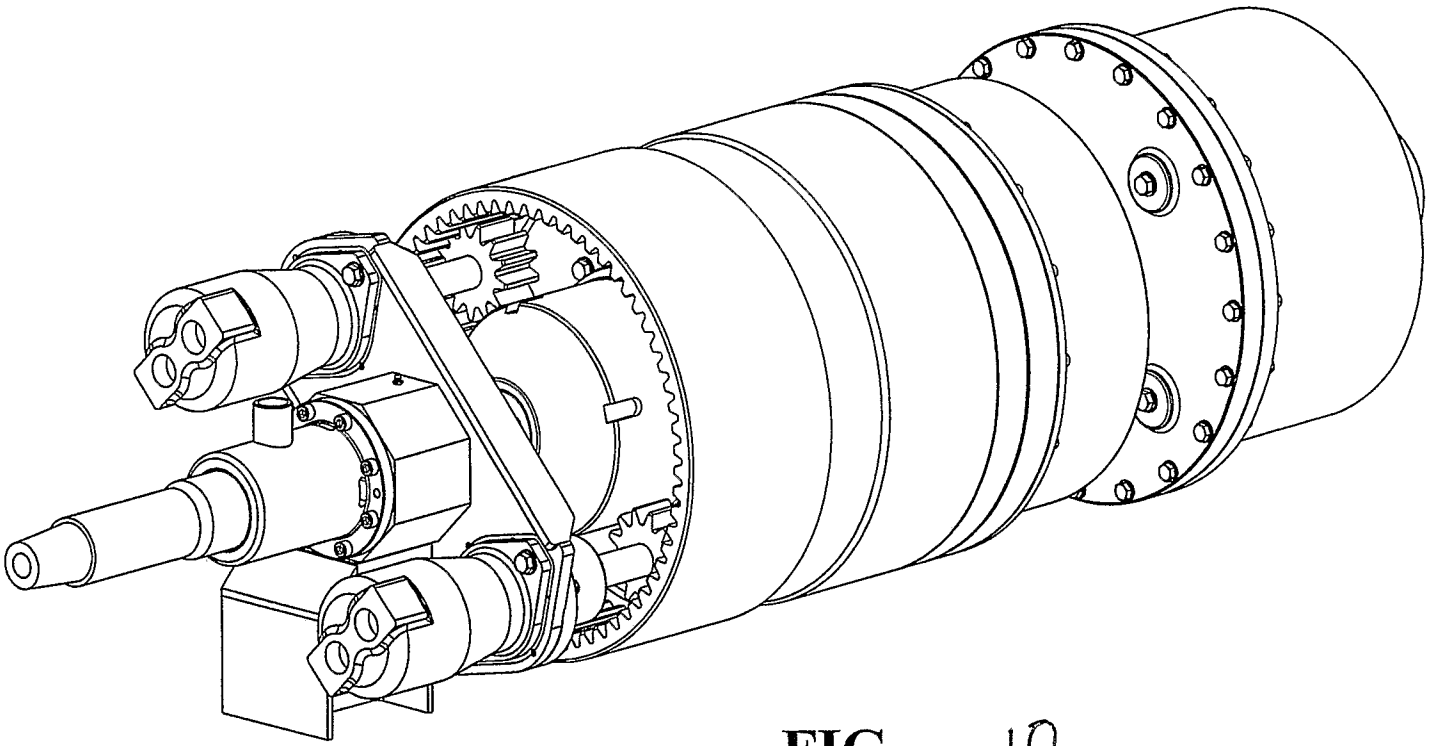
FIG. 10 is an isometric view from the other end of the assembly of FIG. 9.
Figure 11:
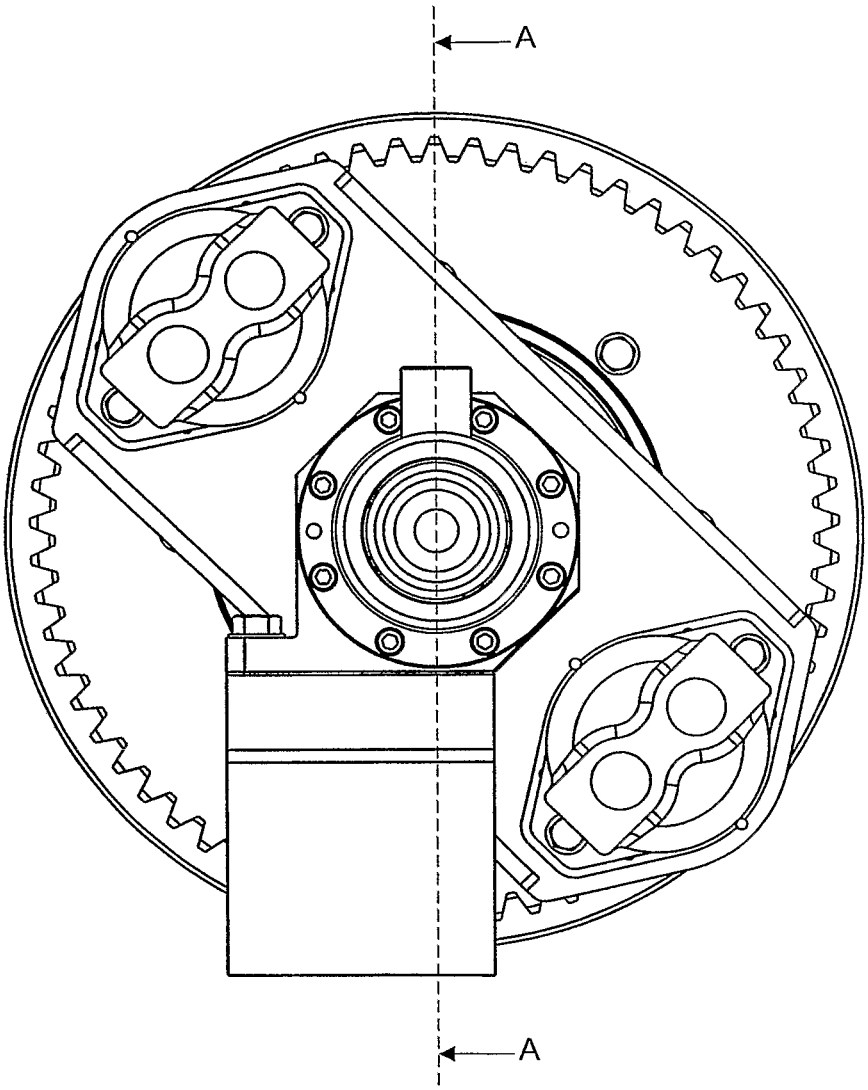
FIG. 11 is a view from the left hand end of the apparatus of FIG. 10.
Figure 12:
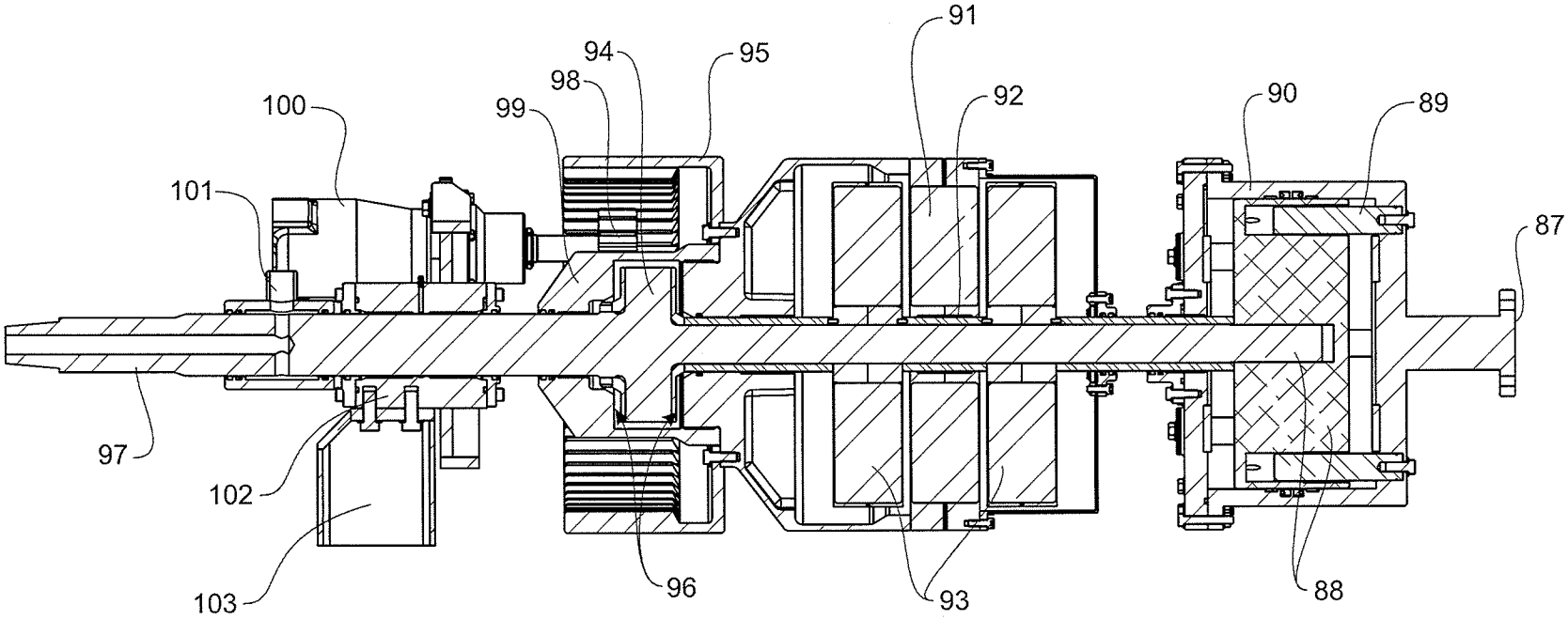
FIG. 12 is a cross-section AA of the apparatus of FIGS. 9 to 11.

FIG. 8 shows yet a further embodiment in accordance with the present invention.

The embodiment of FIG. 8 shows interacting magnetic arrays and a separate mechanical drive for the surround as a shuttle relative to the central spindle to which the other magnetic arrays are mounted. The spindle carries a hammer and being rotatable under appropriate inputs can be caused to reciprocate relative to its surrounding to provide a vibrational and rotational spindle output to the left (with reference to FIG. 8).

In FIG. 8 the vibrational apparatus is shown generally as 70. It has from the right a drive input 71 which via pins 72 rotate the region 73 of the spindle 74. This carries magnetic arrays 75 to interact with magnetic arrays 76 in a manner as hereinafter described. The arrays 76 are fixed relative to the member or assembly 77 which captures the hammer region 78 of the spindle 74. This hammer 78 acts against faces 79 of the assembly 77. These faces 79 are part of a geared peripheral region 80 acted upon by a gear 81 of a hydraulic, pneumatic, electrical or other motor 82. Preferably it is a mechanical drive such as a hydraulic motor.

The member 71 can be driven by any mechanical drive such as a hydraulic motor, electric motor, or other.

The output from the spindle 74 is at 83 into the drill string or the bit.

FIGS. 9 through 12 show a preferred embodiment in accordance with the present invention where there is shown:

87 input drive to give rotary motion
88 centre shaft and bellow piston, screwed together.
89 drive pins
90 air bellow rotates at the same speed as centre shaft
91 hammer end plate bolted to outside magnet assembly (second magnet assembly) rotated by hydraulic motors
92 bearing bush
93 centre magnet assemblies (first magnet assemblies) they rotate with the centre shaft
94 hammer
95 internal gear
96 hammer impact zones
97 centre shaft
98 drive pinion
99 hammer housing bolted to hammer end plate
100 hydraulic motor mounted to bearing support
101 drilling mud inlet
102 bearing support
103 bearing support base attached to drill rig mast sled In this arrangement it can be seen that the drive pinion 98 is able to drive the internal gear 95, the hammer end plate 91 etc, or as a consequence of the input from the hydraulic motor 100.

It will be seen also that the input drive at 87 has the affect of rotating the drive pins 89, the air bellow piston, the centre shaft 97, and the magnetic assemblies 93 in unison.

Another embodiment will now be described with reference to FIGS. 13, 14 and 15, here there is provided

104 input drive from drill string to give drill rotation
105 mud motor
106 mud motor output shaft to give rotation to magnets
107 gas spring
108 drive pins give rotation from mud motor to magnets but doesn't allow vibration back to mud motor
109 centre shaft
110 outside magnet assemblies they rotate with the casing
111 centre magnet assembly rotation from mud motor output shaft
112 hammer
113 hammer impact zone
114 casing
115 drill mud passes through the centre from the mud motor
116 drill bit chuck
117 drill bit.

Figure 13:
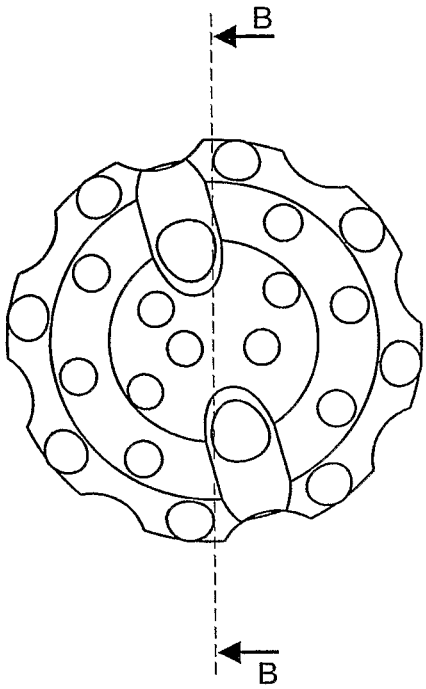
FIG. 13 is a drill head or bit view of an assembly as shown in FIGS. 13 to 15.
Figure 14:
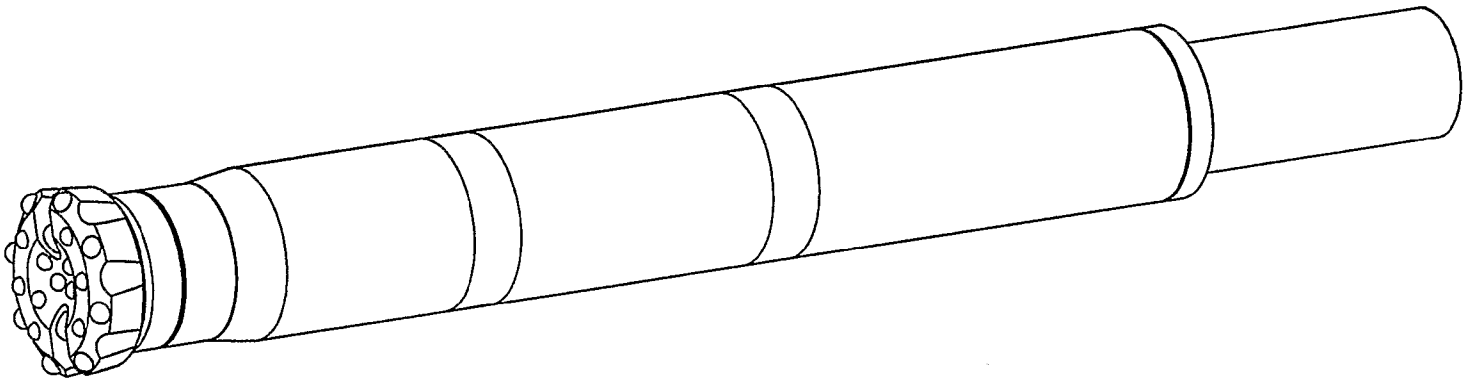
FIG. 14 is an isometric of a downhole assembly of FIGS. 13 through 15.
Figure 15:
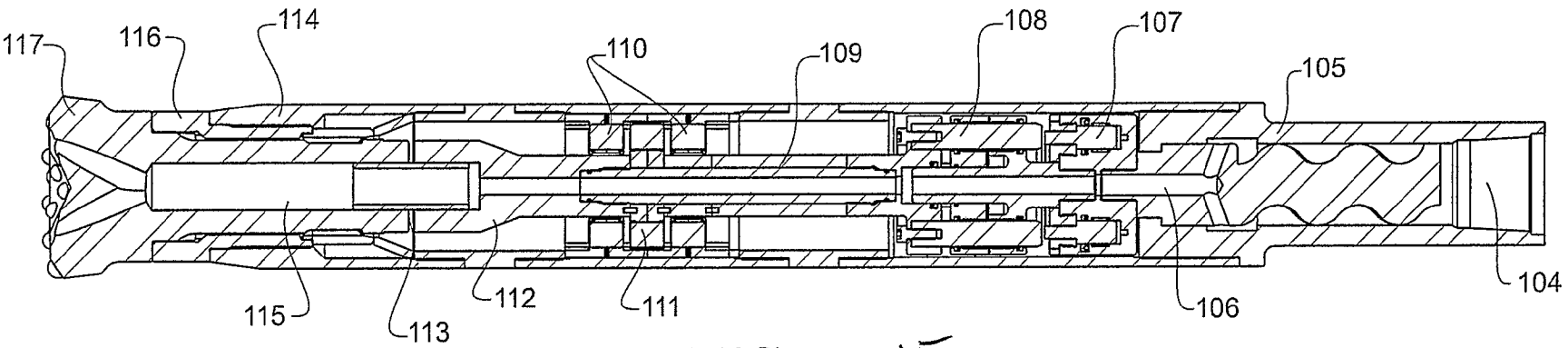
FIG. 15 is a section at BB of the assembly of FIGS. 13 and 14, such apparatus having drive pins to provide rotation from a motor to isolate vibration from the mud motor and having magnetic array assemblies that rotate with the casing about the central shaft, the mud motor mud passing down through the apparatus to exit via the drill bit thus being multi functional.

In the arrangement of FIGS. 13 through 15, the members 104, 110, 114, 116 and 117 all move a rotary motion in unison. The bit vibrates axially but the others don't. The outside casing 114 rotates with the outside magnetic assemblies 110.

A feature of this arrangement is that the central magnet assembly 111 (but not the magnetic assemblies 110 of the casing 114) are rotated by the mud motor output shaft. Another feature is that the hammer 112 in this arrangement acts unidirectionally down towards the drill bit 117 and the gas spring 107 helps isolate vibrational upwardly through the drillstring.

Thus the casing 114 rotates in synchrony with the drillstring in order to cause drill bit rotation whilst the mud motor 105, which provides lubricant mud down through the drill bit 117, causes the vibration by providing relativity of movement of its magnets 110 to those 111 of the centre shaft.

Figure 15A:
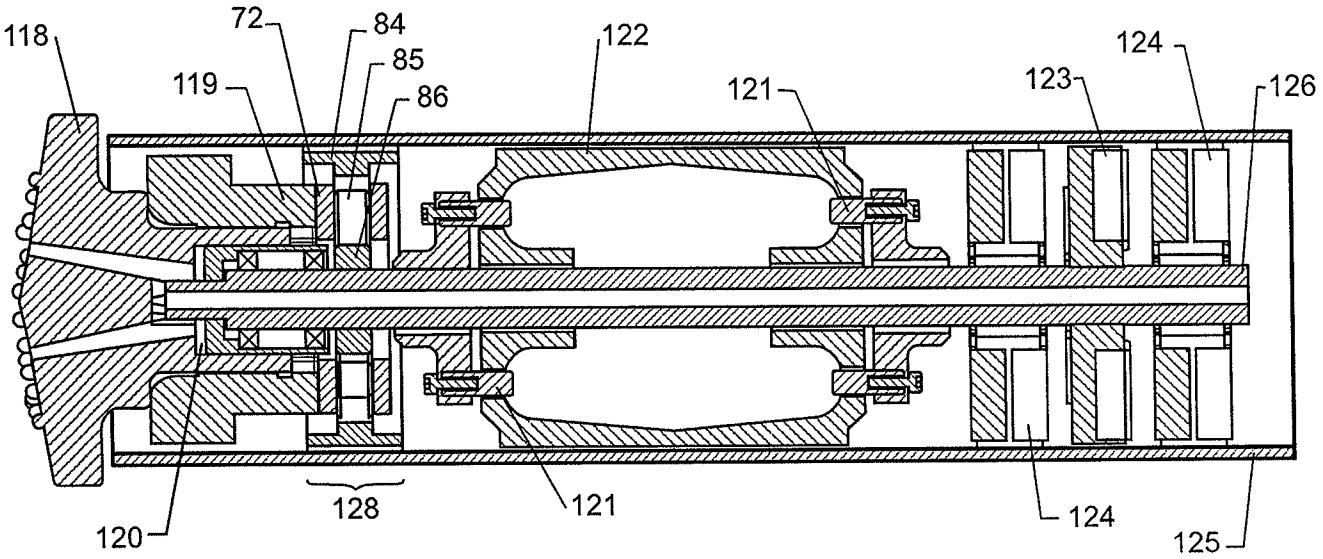
FIG. 15A is a variation of the embodiment of FIG. 15 showing a planetary gearing system (as an example of a gearing system) and a viscous coupling drive.

FIG. 15A shows yet another variant whereby the drill rig provides rotation to the outer casing. As the cutting head engages the formation, it momentarily slows down, causing a torque reaction through a splined chuck to the planet carrier 72, which ceases to rotate. With the outer casing still rotating this causes the annulus gear 84 to rotate which in turn rotates the carrier gears 85—which in turn rotates the sun gear 86. The sun gear 86 is attached to the centre shaft (and rotates at a different—preferably higher speed than the casing, causing a high frequency vibration) which in turn rotates the first rotatable member which reacts relative to the second rotatable member thus inducing impact to the cutting head.

Further the sun gear 86 drives the centre shaft which via drive pins rotates the viscous coupling (again at high RPM due to the planetary gearing) which causes a reverse torque reaction via 86, 85, 84 and 72 which is attached to the chuck spline and ultimately the cutting head. This feature can provide considerable rotary torque to rotate the cutting head—which may be needed in certain ground formations.

Figure 16:
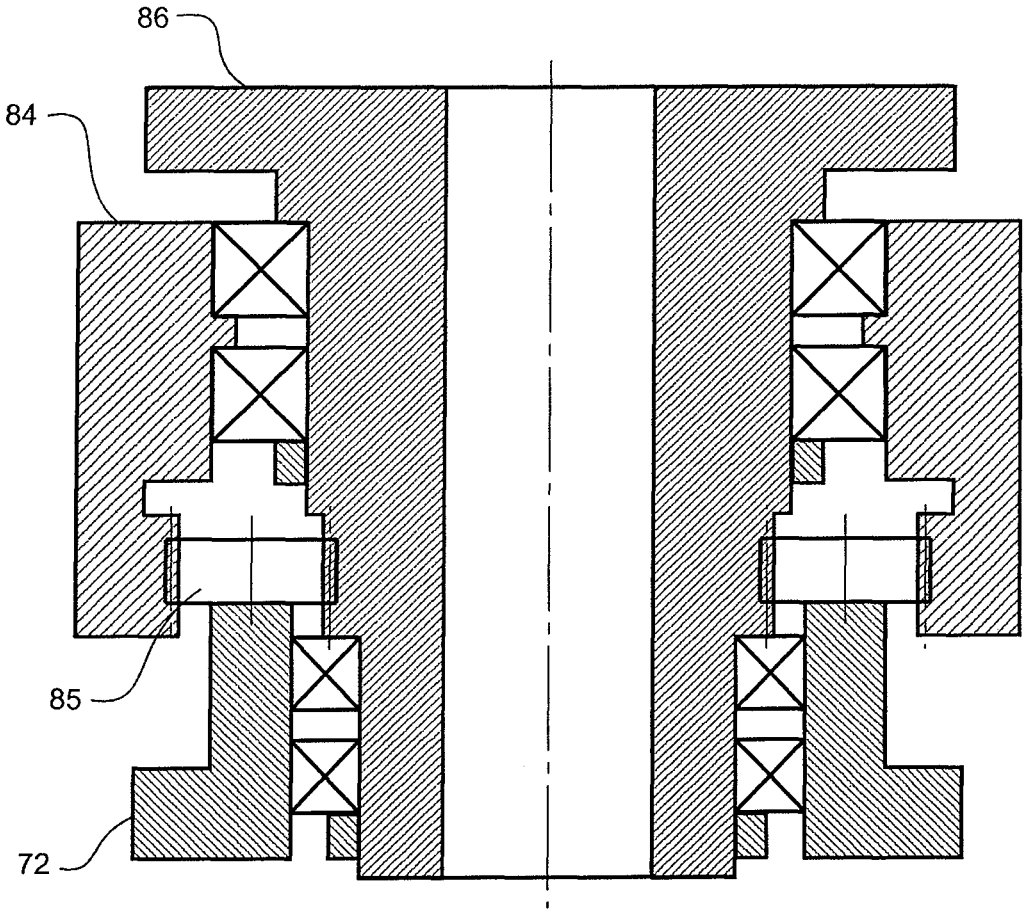
FIG. 16 is a cross-section of a planetary gear box as used in FIG. 15A.

In FIG. 15A there is shown:

118—cutting head
119—chuck splined to cutting head
120—hammer zone
121—drive pins
122—viscous coupling
123—first rotatable member
124—second rotatable member
125—casing powered by drillstring rotation
126—centre shaft
128—zone of planetary gear as shown in FIG. 16.

FIG. 16 shows in more detail the planetary as gearing as used in 15A.

In FIG. 16 there is shown:

86—sun gear (fixed to center shaft)
84—annulus gear (fixed to casing)
85—carrier gears
72—planet carrier (fixed to chuck)

The magnetic interactions can be substantially as disclosed in our PCT/NZ2005/000329 and PCT/NZ2006/000244.

It is envisaged that banks of arrays can be interspersed for the same but a greater effect.

As disclosed in our WO 2006/065155 (PCT/NZ2005/000329) there is a disclosure of a shuttle being reciprocated by magnetic means. Ends of the shuttle (howsoever long) have electromagnets or (preferably) rare earth magnets fitted and captive (eg, as frustoconical forms captive under a complementary fixed plate). In such an arrangement, the shuttle when rotated pulses responsive to adjacent members also fitted with magnets.

In such a way the shuttle can reciprocate relative to an arbitrary datum of the magnetic arrays not carried by the shuttle. This will be described hereafter with particular reference to the FIGS. 17 and 18 which are FIGS. 3 and 4 of WO 2006/065155. The full content of WO 2006/065155 is here included by way of reference.

Figure 17:
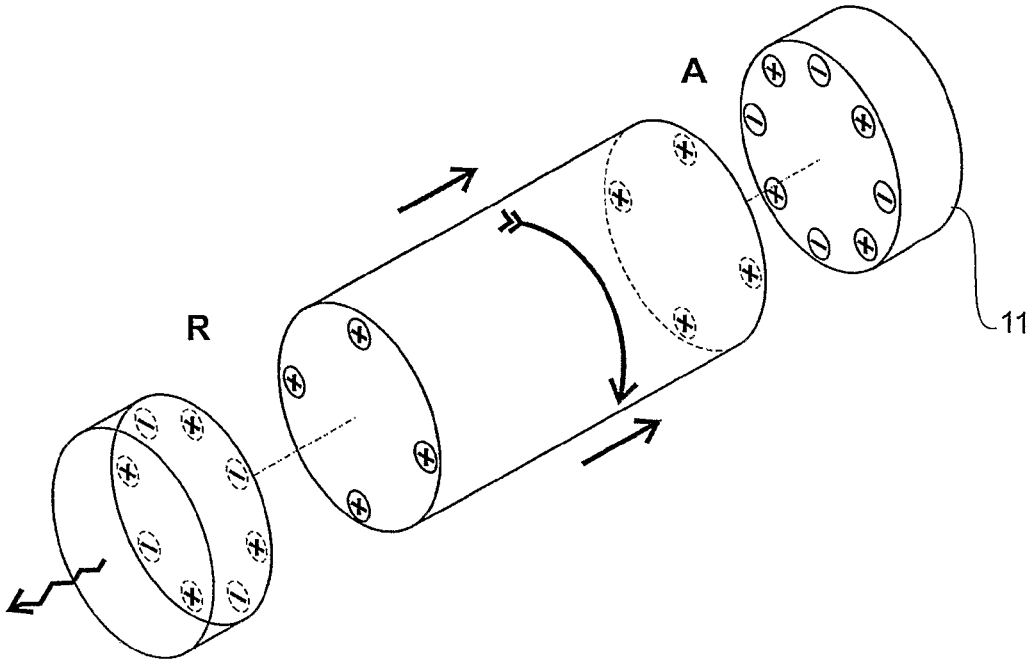
FIG. 17 is a diagrammatic view showing rotation of a magnetic array in a clockwise sense (whether of the first or secondary rotational member) relative to the (of any length) arrays of the other of the first or secondary rotational members and showing with "R" and "A" a circumstance of repulsion and attraction respectively between the complementary arrays such that there is a net mutual shuttling thrust in the arrowed direction.
Figure 18:
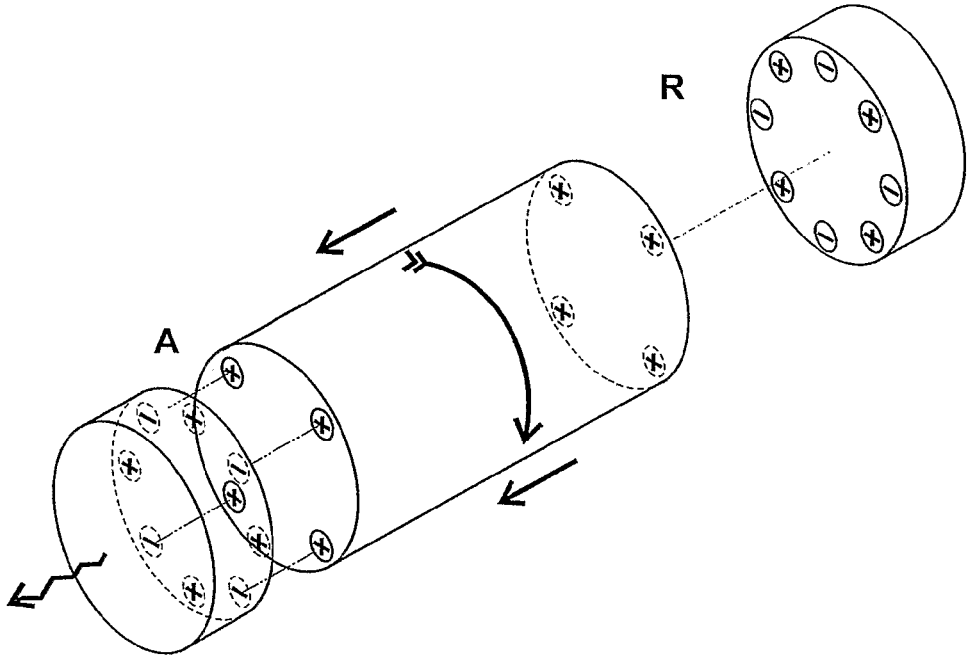
FIG. 18 shows the arrangement as in FIG. 17 at a moment in time later when there is a reversal of the attractive "A" and repulsive "R" forces between the pairings of the magnetic arrays, there being a net mutual shuttling thrust in the arrowed direction.

FIGS. 17 and 18 by reference to regions of different polarity of permanent or other magnets shows the effect. The broken zigzagging arrow is indicative in WO 2006/065155 of power take off from a first complementary structure.

In the arrangement shown there is a second complementary structure shown out of phase so far as the "plus" and "minus" polarities depicted are concerned. The shuttle optionally has the same polarity at each end such that, in a condition as shown in FIG. 17, there is a net repulsive force arising from alignment of "plus" and "plus" polarities between the shuttle and the first complementary structure whilst, at the same time, there is a "plus" and "minus" attractive force "A" between the shuttle and the second complementary structure.

A short moment in time later the opposite situation, exists and it is this rapid alternating of "R" and "A" to "A" and "R" that leads to the reversal in shuttle direction as the shuttle rotates or the shuttle is held from rotating and the other magnetic arrays are rotated, or both, to provide a net affect.

Preferably used are permanent magnets (particularly Rare Earth type magnets of high magnetic density, eg, Neodymium magnets, such as those of NdFeB, can be stable to 180° C. and Samarium Cobalt magnetic (FmCo) which can be used up to 400° C.).

Other forms of magnet can be utilised including those magnets that may be developed in the future. Generally speaking however, electro magnets are contra-indicated purely from the point of view of size and the need to provide adequate electrical inputs in a structure that does vibrate and is subject to adverse environments. It is envisaged that rotational speeds for the shuttle can vary significantly. A mere example of one such rotation is 1600 RPM which is sufficient, with magnets as depicted, to provide a sufficient relative throw backwards and forwards, irrespective of which member hammers as in our preferred embodiments to the drill, to provide a worthwhile vibrational output. Usual ranges can be from 1000 to 2000 RPM but can be higher or lower. 2000 RPM equates to approximately 130 Hz.

The invention claimed is:

1. A drilling apparatus comprising a drillstring, the drilling apparatus operable to rotate the drillstring or at least a drill head or a bit of the drillstring, or both, and operable to provide vibration axially to the drill head or bit;

a vibrational apparatus positioned as part of the drillstring or in the drillstring to provide said vibration;

said vibrational apparatus having interactive magnetic arrays, there being at least one first assembly with a first array, being a magnetic array or set of magnetic arrays, and there being at least one second assembly with a second array, being a magnetic array or set of magnetic arrays, such that the first array and the second array interact, responsive to relative rotation between said first array and said second array, to cause shuttling of the first array relative to the second array, or vice versa, or both, and thus their respective supporting assemblies;

one of the first or second array and its assembly being held relative to or by the drillstring to move synchronously in rotation with the drillstring when the drillstring is rotated;

a mechanical input to rotate, independently of said drillstring, said other of said first assembly and said second assembly;

relative rotation between the first assembly and the second assembly being caused by the independent mechanical input and rotation of the drillstring or the drill head or the bit of the drillstring, the drill head or bit vibrating as a consequence of direct or indirect hammering of the drill head or bit by the first assembly or the second assembly, or both.

2. The apparatus of claim 1, wherein the drill head or bit vibrates as a consequence of direct or indirect carrying of or hammering of, or both, the drill head or bit by the first assembly.

3. The apparatus of claim 1, wherein the drill head or bit vibrates as a consequence of, direct or indirect, carrying of or hammering of, the drill head or bit by the second assembly.

4. The apparatus of claim 1, wherein the first and second array and their first and second assembly rotate in opposite directions.

5. The apparatus of claim 1, wherein the first and second array and their first and second assembly rotate in a same direction.

6. The apparatus of claim 1, wherein one of the first and second array and its first and second assembly is non-rotating when the other of the first and second array and first and second assembly is rotating.

7. The apparatus of claim 1, wherein the vibrational apparatus is below a rotational drive driving the drillstring.

8. The apparatus of claim 1, wherein a rotary drive into a spindle as one of first and second rotatable members causes unidirectional or bidirectional hammering.

9. The apparatus of claim 8, wherein said rotary drive is a mud motor, fluid motor, an electric motor or other mechanical or electrical drive.

10. The apparatus of claim 8, wherein the other of said first and second rotatable members is rotatable by or with the drillstring.

11. The apparatus of claim 8, wherein gearing provides a rotary speed greater or less for one of said magnetic array and/or bit rotation speed relative to a rotary drive input.

12. The apparatus of claim 8, wherein a viscous coupling provides a drive to one of said magnetic arrays.

13. The apparatus of claim 1, wherein the drillstring rotates a cutter and there is a drill head internally of the cutter (i) able to be rotated differently to the drillstring insofar as speed is concerned, (ii) able to be vibrated relative to the cuter of the drillstring, or (iii) both.

14. The apparatus of claim 1, wherein the magnetic arrays are staged axially with respect to the drillstring axis.

15. The apparatus of claim 14, wherein at least one magnetic array of one of the magnetic arrays is interposed between arrays of the other magnetic arrays.

* * * * *

UNITED STATES PATENT AND TRADEMARK OFFICE

CERTIFICATE OF CORRECTION

PATENT NO. : 8,561,723 B2
APPLICATION NO. : 12/733425
DATED : October 22, 2013
INVENTOR(S) : Powell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 394 days.

Signed and Sealed this
Fifteenth Day of September, 2015

Michelle K. Lee

Michelle K. Lee
*Director of the United States Patent and Trademark Office*